US007861799B2

(12) United States Patent
Iwakami et al.

(10) Patent No.: US 7,861,799 B2
(45) Date of Patent: Jan. 4, 2011

(54) IMPACT TOOL

(75) Inventors: Junichi Iwakami, Anjo (JP); Shinji Onoda, Anjo (JP); Takamasa Hanai, Anjo (JP)

(73) Assignee: Makita Corporation, Anjo-shi (JP)

( * ) Notice: Subject to any disclaimer, the term of this patent is extended or adjusted under 35 U.S.C. 154(b) by 140 days.

(21) Appl. No.: 12/382,536

(22) Filed: Mar. 18, 2009

(65) Prior Publication Data

US 2009/0236110 A1 Sep. 24, 2009

(30) Foreign Application Priority Data

Mar. 21, 2008 (JP) ..... 2008-074632
Mar. 21, 2008 (JP) ..... 2008-074673

(51) Int. Cl.
*B25D 11/04* (2006.01)

(52) U.S. Cl. ..... 173/201; 173/48; 173/109

(58) Field of Classification Search ..... 173/47, 173/48, 104, 109, 201, 178, 216
See application file for complete search history.

(56) References Cited

U.S. PATENT DOCUMENTS 5,775,440 A * 7/1998 Shinma ..... 173/109
6,073,705 A 6/2000 Shibata et al.
6,116,352 A * 9/2000 Frauhammer et al. ..... 173/212
6,131,671 A * 10/2000 Shibata et al. ..... 173/48
6,155,356 A 12/2000 Kikuchi et al.
6,725,944 B2 * 4/2004 Burger et al. ..... 173/48
6,976,545 B2 * 12/2005 Greitmann ..... 173/104
7,051,820 B2 * 5/2006 Stirm ..... 173/109
7,143,842 B2 * 12/2006 Ikuta ..... 173/201
7,325,624 B2 * 2/2008 Yamazaki ..... 173/48
7,334,647 B2 * 2/2008 Hahn ..... 173/178
7,469,752 B2 12/2008 Furusawa et al.
2001/0008186 A1 7/2001 Frauhammer et al.

(Continued)

FOREIGN PATENT DOCUMENTS

CN 1974139 A 6/2007

(Continued)

OTHER PUBLICATIONS

Mar. 31, 2010 Office Action issued in Chinese Patent Application No. 200910129467.5 (with translation).

*Primary Examiner*—Scott A. Smith
(74) *Attorney, Agent, or Firm*—Oliff & Berridge, PLC

(57) ABSTRACT

It is an object of the invention to provide a technique which is effective in improving the durability of an angular positioning device of a tool bit and in reducing weight of a tool body in an impact tool. A representative impact tool includes a tool body, a lubricant sealed in the housing space, a driving mechanism, a tool holder, an angular positioning device disposed on a tip end side of the tool body and serves to fix a position of the tool bit around the axis with respect to the tool body. The angular positioning device includes first and second locking members. The first locking member is disposed between the tool body and the tool holder. The second locking member is disposed opposite to the first locking member. One end of the first locking member in the axial direction of the tool bit extends into the housing space of the tool body and is connected to the tool body within the housing space.

11 Claims, 9 Drawing Sheets

U.S. PATENT DOCUMENTS

2005/0269116 A1 12/2005 Frauhammer et al.

FOREIGN PATENT DOCUMENTS

| | | | |
|---|---|---|---|
| DE | 36 27 869 | A1 | 2/1988 |
| DE | 100 58 994 | A1 | 6/2002 |
| EP | 1 792 692 | A2 | 6/2007 |
| GB | 2 371 008 | A | 7/2002 |
| JP | A-11-104974 | | 4/1999 |
| JP | A-2000-127066 | | 5/2000 |
| WO | WO 88/01219 | A1 | 2/1988 |

* cited by examiner

IMPACT TOOL

BACKGROUND OF THE INVENTION

1. Field of the Invention

The invention relates to a technique of providing new and useful impact tool.

2. Description of the Related Art

An impact tool is provided with an angular positioning device which positions a hammer bit in its circumferential direction with respect to a tool body during hammering operation. For example, Japanese non-examined laid-open Patent publication No. 11-104974 discloses an impact tool having such an angular positioning device. The angular positioning device in the above publication is disposed in a tip end region of a barrel which forms a tool body. In the angular positioning device, a locking member is disposed between a barrel and a tool holder for holding the hammer bit. The locking member is normally connected via a spline fit with respect to the tool holder and can be connected to or disconnected from the barrel via engagement of projections and recesses. The position of the tool bit is adjusted by appropriately rotating the tool bit together with the tool holder in a state in which the locking member is disconnected from the barrel. Thereafter, the tool bit is fixedly positioned in the adjusted position by connecting the locking member to the barrel again.

In a construction in which the angular positioning device is disposed in the tip end region of the barrel, the angular positioning device is located close to the tool bit to be positioned. Therefore, the operability of the angular positioning device can be advantageously enhanced, but on the other hand, the angular positioning device is affected by dust of a workpiece (concrete) which is generated during hammering operation. Specifically, a connection between the locking member and the tool holder and a connection between the locking member and the barrel are caused to be susceptible to wear by entry of dust. Therefore, each of members of the angular positioning device including the barrel is formed from wear-resistant materials such as ferrous materials in order to enhance durability. Further, the impact tool which is held by the user's hand in hammering operation is desired to be as light as possible, and particularly as for the barrel having a relatively large volume, such is highly desired. However, if the barrel is formed from lighter materials than ferrous materials, such as nonferrous metals and synthetic resins, the required wear resistance cannot be ensured. In this point, further improvement is required.

On the other hand, Japanese non-examined laid-open Patent Publication No. 2000-127066 discloses an impact tool having an impact absorption mechanism for absorbing an impact during an idle driving movement. The known impact absorption mechanism is designed such that, when a tool bit is held away from a workpiece and a striker performs a striking movement, an elastic element is subjected to a load of an intermediate element which moves forward together with the striker, and thereby absorbs an impact caused by the striking movement of the striker. In other words, the impact absorption mechanism in the known impact tool is designed such that mainly one elastic element is subjected to an impact caused by the striker during idle driving. Therefore, the elastic element is subjected to a heavy load, so that further improvement is required in durability.

SUMMARY OF THE INVENTION

Accordingly, it is a first object of the invention to provide a technique which is effective in improving the durability of an angular positioning device of a tool bit and in reducing weight of a tool body in an impact tool.

Moreover, it is further a second object of the invention to provide a technique that contributes to improvement in durability of an impact absorption mechanism for absorbing impact during idle driving in an impact tool.

In order to achieve the above-described first object, in a preferred embodiment according to the invention, a representative impact tool which performs a predetermined hammering operation on a workpiece by a striking movement of a tool bit in an axial direction of the tool bit includes a tool body having a housing space, a lubricant sealed in the housing space and a driving mechanism which is housed within the housing space and drives the tool bit disposed in a tip end region of the tool body in the axial direction. Further, the "predetermined hammering operation" in this invention suitably includes not only a hammering operation in which the tool bit performs only a linear striking movement, but a hammer drill operation in which it performs a linear striking movement and a rotation in its circumferential direction.

According to the preferred embodiment of the impact tool according to the invention, the representative impact tool includes a tool holder which holds the tool bit in such a manner that the tool bit cannot rotate around an axis of the tool bit with respect to the tool holder and which is disposed in the tool body in such a manner that it can rotate around the axis of the tool bit, and an angular positioning device which is disposed on a tip end side of the tool body and serves to fix a position of the tool bit around the axis with respect to the tool body. The angular positioning device has first and second locking members. The first locking member is disposed between the tool body and the tool holder in a direction transverse to the axial direction of the tool bit, and connected to the tool body in such a manner that the first locking member cannot rotate around the axis of the tool bit with respect to the tool body and can rotate around the axis of the tool bit with respect to the tool holder. The second locking member is disposed opposite to the first locking member and connected to the tool holder in such a manner that it cannot rotate around the axis of the tool bit while being allowed to move in the axial direction of the tool bit with respect to the tool holder. Further, the second locking member can be connected to or disconnected from the first locking member according to the movement of the second locking member in the axial direction of the tool bit, in such a manner that it cannot rotate around the axis of the tool bit with respect to the first locking member. One end of the first locking member in the axial direction of the tool bit extends into the housing space of the tool body and is connected to the tool body within the housing space. The "first and second locking members" in this invention are typically formed by a cylindrical member, but suitably include those formed by a semi-cylindrical member.

The angular positioning device in the invention is disposed in the tip end region of the tool body. This position is located close to the tool bit to be positioned, so that the angular positioning device can achieve higher operability. On the other hand, the angular positioning device is exposed to dust which is generated during hammering operation and caused to be susceptible to wear. Therefore, in the invention, connection between the first locking member and the tool body is made in the housing space of the tool body or in oil. Thus, the connection between the first locking member and the tool body can be avoided from being adversely affected by dust during hammering operation and protected by the lubricant sealed in the housing space. Therefore, as for the tool body which occupies a much larger volume compared with the first and second locking members, while its wear problem is solved, it is formed from nonferrous metals such as an aluminum alloy and a synthetic resin which are lighter in weight than ferrous materials, so that the weight of the impact tool can be reduced. Further, the first locking member and the second locking member are formed from wear-resistant ferrous materials, so that their durability can be enhanced.

According to a further embodiment of the impact tool of the invention, a third locking member is disposed between the first locking member and the second locking member in the axial direction of the tool bit. The third locking member is normally connected to the first locking member and can be connected to or disconnected from the second locking member according to the movement of the second locking member in the axial direction of the tool bit. Further, one surface of the third locking member in a direction transverse to the axial direction of the tool bit contacts the tool body and the other surface contacts a surface of the tool holder which extends in a direction transverse to the axial direction, so that the third locking member serves as a stopper for preventing the tool holder from moving toward the housing space. Specifically, in the invention, the tool holder contacts the end surface of the tool body on the tip end side in the axial direction of the tool bit via the third locking member, so that the tool holder is prevented from moving to the housing space side.

When the tool holder is mounted within the tool body, for example, by inserting the tool holder from the housing space side of the tool body toward the tip end side, the inserted tool holder needs to be prevented from becoming detached from the tool body. According to the invention, the stopper ring is fitted onto the inserted tool holder. The stopper ring contacts the third locking member which is held in contact with the tool body and thus locked against movement in a direction in which it may become detached. As a result, the tool holder is locked against movement in a direction in which it may become detached. Specifically, according to the invention, the third locking member can be provided with not only a primary function of positioning but a function as a stopper for the tool holder, so that a rational construction for preventing the tool holder from becoming detached can be realized.

According to a further embodiment of the impact tool of the invention, the second locking member and the third locking member have projections and recesses, respectively, in regions opposite to each other in the axial direction of the tool bit and are connected to each other by engagement of the projections and recesses. With such construction, the second locking member can be smoothly connected to or disconnected from the third locking member by moving the second locking member in the axial direction of the tool bit.

According to a further embodiment of the impact tool of the invention, the angular positioning device has an operating member which is operated to move the second locking member in the axial direction of the tool bit, and one end of the operating member is connected to the second locking member and the other end is exposed on the tool body such that the operating member can be manually operated by a user. According to this invention, the second locking member can be easily operated from outside the tool body.

According to a further embodiment of the impact tool of the invention, a tool holder guide made of a ferrous material is radially disposed between the tool body and the tool holder in a direction transverse to the axial direction of the tool bit and the tool holder guide forms the first locking member. With such construction, the tool holder guide or the first locking member can be made of a ferrous material, so that durability can be enhanced.

In order to achieve the above-described second object, in a preferred embodiment according to the invention, a representative impact tool which performs a predetermined hammering operation on a workpiece by a striking movement of a tool bit in an axial direction of the tool bit includes a striker, an intermediate element, a first receiving portion, a second receiving portion, a first elastic element and a second elastic element. Further, the "predetermined hammering operation" in this invention suitably includes not only a hammering operation in which the tool bit performs only a striking movement in its axial direction, but a hammer drill operation in which it performs a linear striking movement and a rotation in its circumferential direction. The striker linearly moves forward in order to strike the tool bit. The intermediate element transmits a striking force of the striker to the tool bit. The first receiving portion contacts the striker when the striker further moves forward beyond a predetermined striking position in order to strike the intermediate element. The second receiving portion contacts the intermediate element when the striker moves forward beyond the striking position and strikes and moves the intermediate element forward. The first elastic element is held in contact with the first receiving portion and elastically deforms by an impact which is caused by contact of the striker with the first receiving portion and transmitted to the first elastic element. The second elastic element is prevented from moving forward by the tool body or by a member on the tool body side which is prevented from moving forward by the tool body. Further, the second elastic element is held in contact with the first and second receiving portions and elastically deforms by an impact which is caused by contact of the striker with the first receiving portion and transmitted from the first receiving portion, and by an impact which is caused by contact of the intermediate element with the second receiving portion and transmitted from the second receiving portion.

According to the preferred embodiment of the invention, the first and second receiving portions are disposed side by side in contact with the second elastic element. Further, the manner of being "disposed side by side in contact" with the second elastic element in this invention suitably includes the manner of being disposed side by side in the radial direction of the tool bit and held in contact with the second elastic element and the manner of being disposed side by side in the circumferential direction of the tool bit and held in contact with the second elastic element. According to the invention, the first and second elastic elements can share and absorb an impact caused by the idle driving movement of the striker, so that the durability of the elastic elements can be improved. Further, in this invention, with the construction in which the first receiving portion and the second receiving portion are disposed side by side in contact with the second elastic element, an impact on the side of the striker can be effectively transmitted to the second elastic element, regardless of timing of contact of the striker with the first receiving portion and contact of the intermediate element with the second receiving portion. The "first and second elastic elements" in this invention typically comprise rubber. Further, the "first and second elastic elements" suitably include both of those which are continuously formed around the axis (in the circumferential direction) of the tool bit and those which are discontinuously formed around the axis of the tool bit.

According to a further embodiment of the invention, one of the first and second receiving portions is held in contact with a radially outward portion of the second elastic element and the other receiving portion is held in contact with a radially inward portion of the second elastic element. With such construction, impact transmission from the first and second receiving portions to the second elastic element can be realized in a rational arrangement.

According to a further embodiment of the invention, the first receiving portion comprises a stepped member having a protrusion extending forward from its radially outer edge and is held in contact with the radially outward portion of the second elastic element via the protrusion. The "protrusion" in this invention typically comprises the protrusion which is continuously formed in the circumferential direction of the tool bit, but it also suitably includes the protrusion which is discontinuously formed in the circumferential direction of the tool bit. In this invention, with the above-described construction, the first receiving portion can transmit an impact to the radially outward portion of the second elastic element via its protrusion, while avoiding interference with the second receiving portion which is held in contact with the radially inward portion of the second elastic element. Further, when the second receiving portion is formed, for example, by the tool holder for holding the tool bit, interference with the tool holder can be avoided. Therefore, even if the first and second elastic elements are installed under a pre-load, the tool holder has no resistance. Therefore, this construction does not affect the operability in rotating the tool holder in the circumferential direction together with the tool bit in order to position the tool bit in its circumferential direction.

According to a further embodiment of the invention, the stepped member having the protrusion is disposed on the front and rear sides of the first elastic element. The front and rear stepped members have the same shape and are disposed in symmetry on the both sides of the first elastic element. With such construction, the front and rear stepped members can be common parts. Therefore, proper installation of the front and rear stepped sleeves is ensured, so that ease of assembly can be improved.

Some impact tools have an idle driving prevention mechanism of such a type that prevents the striker from repeating idle driving movement by holding the striker in the forward position when the striker is further moved forward beyond the striking position. Such an idle driving prevention mechanism includes a front bore space which is provided to prevent the idle driving movement and defined in the forward portion of the cylinder in which the striker is slidably housed, an air vent that provides communication between the outside and the inside of the front bore space, and a non-return valve that normally closes the air vent, while being pushed outward by the air escaping through the air vent when the striker moves further forward beyond the striking position within the front bore space. When the striker that slides within the cylinder moves further forward beyond the predetermined striking position of the intermediate element, air within the front bore space is compressed by the striker and pushes the non-return valve (O-ring) outward so that the air escapes to the outside through the air vent formed in the cylinder. Thereafter, when the striker tries to move back to its pre-striking position, a negative pressure is caused in the front bore space because the non-return valve prevents inflow of outside air. As a result, the striker is prevented from moving back and held in a position forward of the striking position. Thus, the striker is prevented from repeating idle driving movement. In such an idle driving prevention mechanism using a non-return valve, when the non-return valve is pushed outward by the air escaping through the air vent, the non-return valve may be displaced in the axial direction of the tool bit.

According to the invention, when this invention is applied to an impact tool having an idle driving prevention mechanism as described above, the protrusion of the rear stepped member can be disposed opposite to a side of the non-return valve in its axial direction. Therefore, when the non-return valve is pushed outward, the protrusion can prevent the non-return valve from being displaced in its axial direction, so that any problem which may be caused by displacement of the non-return valve can be avoided.

According to a further embodiment of the invention, the impact tool further includes a cylinder that houses the striker and has a rear end surface and a front end surface in the axial direction of the tool bit which are held in contact with the tool body and the first receiving portion, respectively. Further, the first and second elastic elements are installed under a predetermined pre-load, so that the cylinder is held in the axial direction of the tool bit. According to the invention, the cylinder can be held by the elastic forces of the first and second elastic elements, so that a member for holding the cylinder (O-ring) can be omitted. Further, rattling of the cylinder is suppressed, so that vibration in the impact tool can be lowered.

DETAILED DESCRIPTION OF THE INVENTION

First Representative Embodiment

Figure 1:
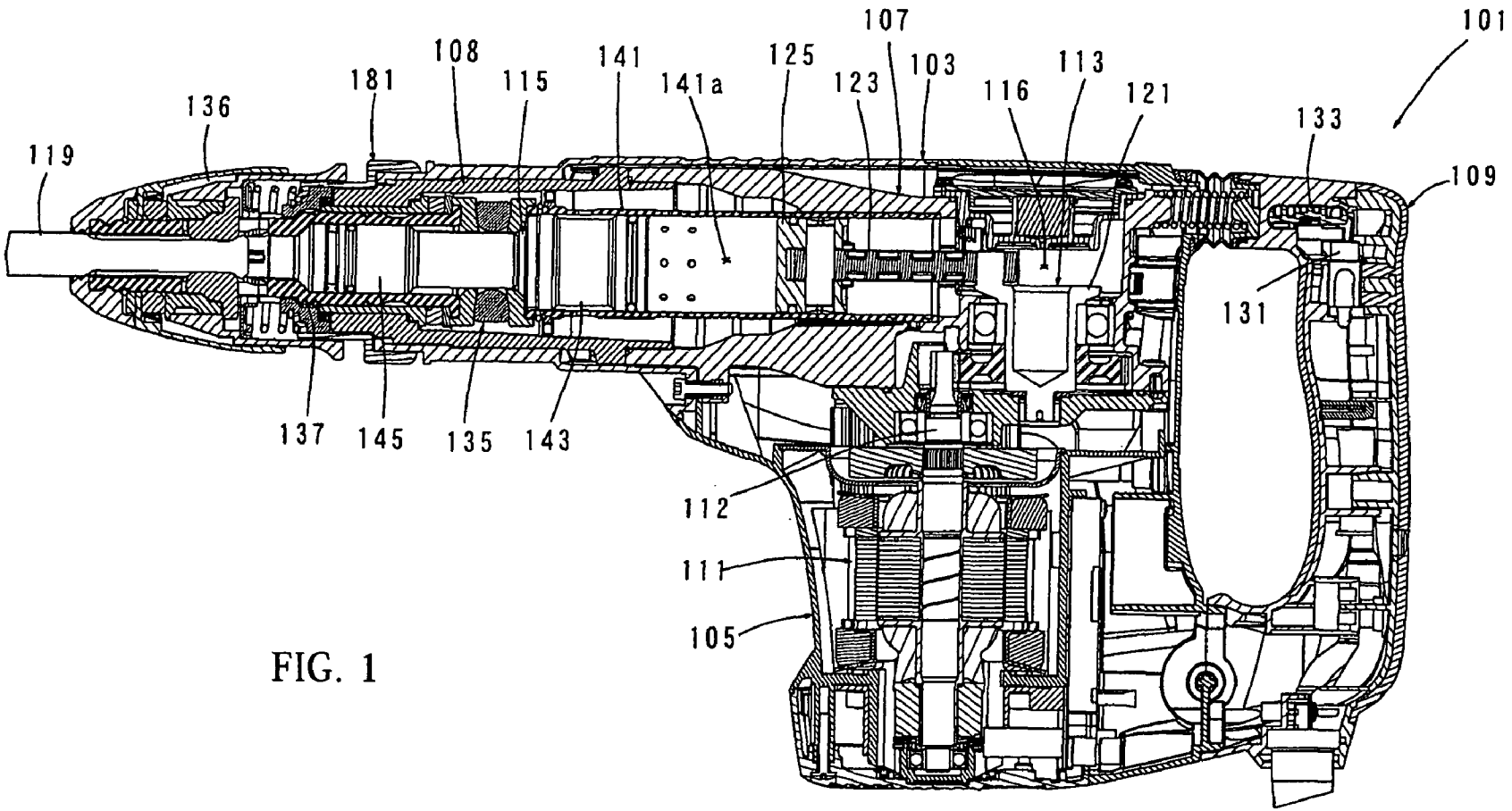
FIG. 1 is a sectional view showing an entire structure of an electric hammer according to an embodiment of this invention.
Figure 2:
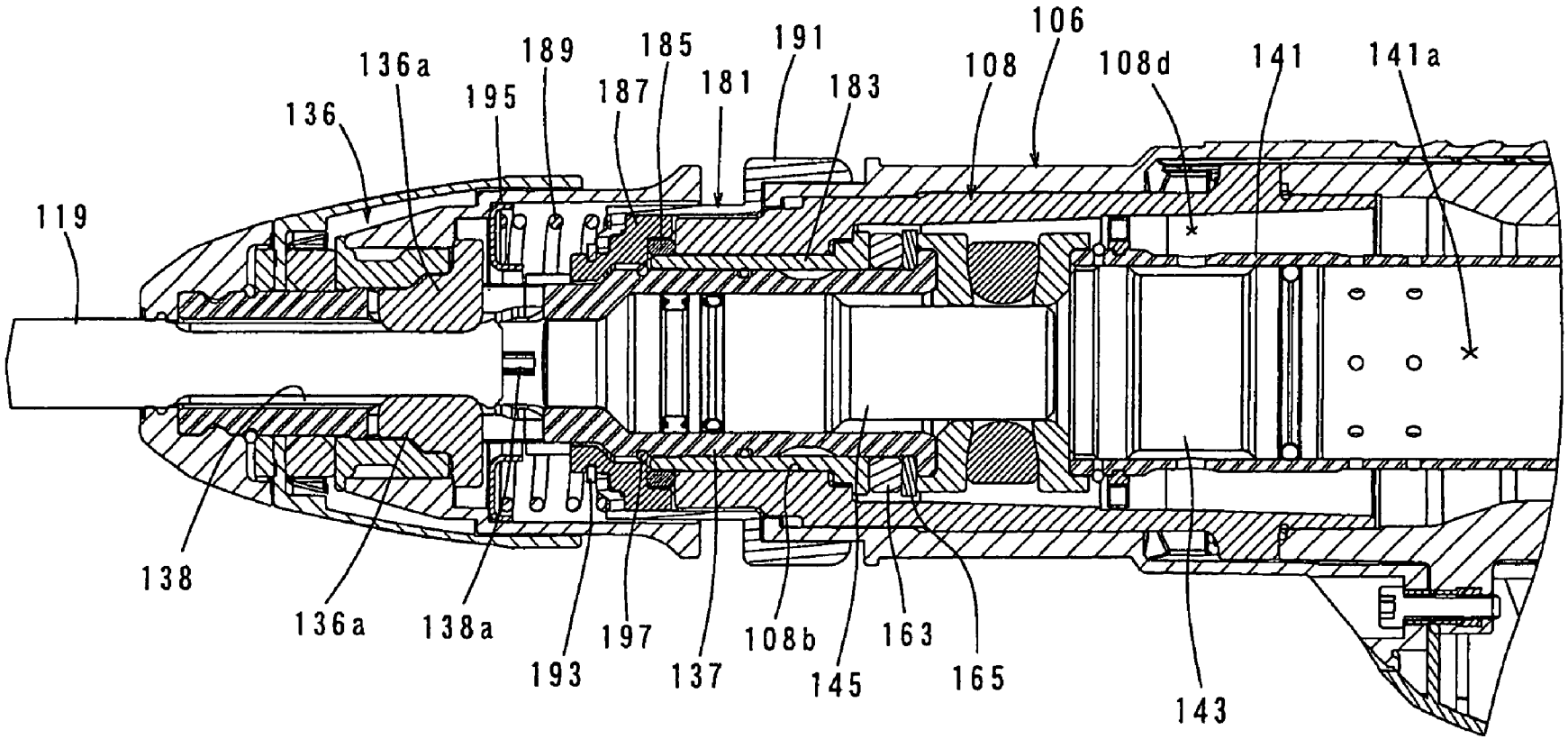
FIG. 2 is a sectional view showing an essential part of the electric hammer.
Figure 3:
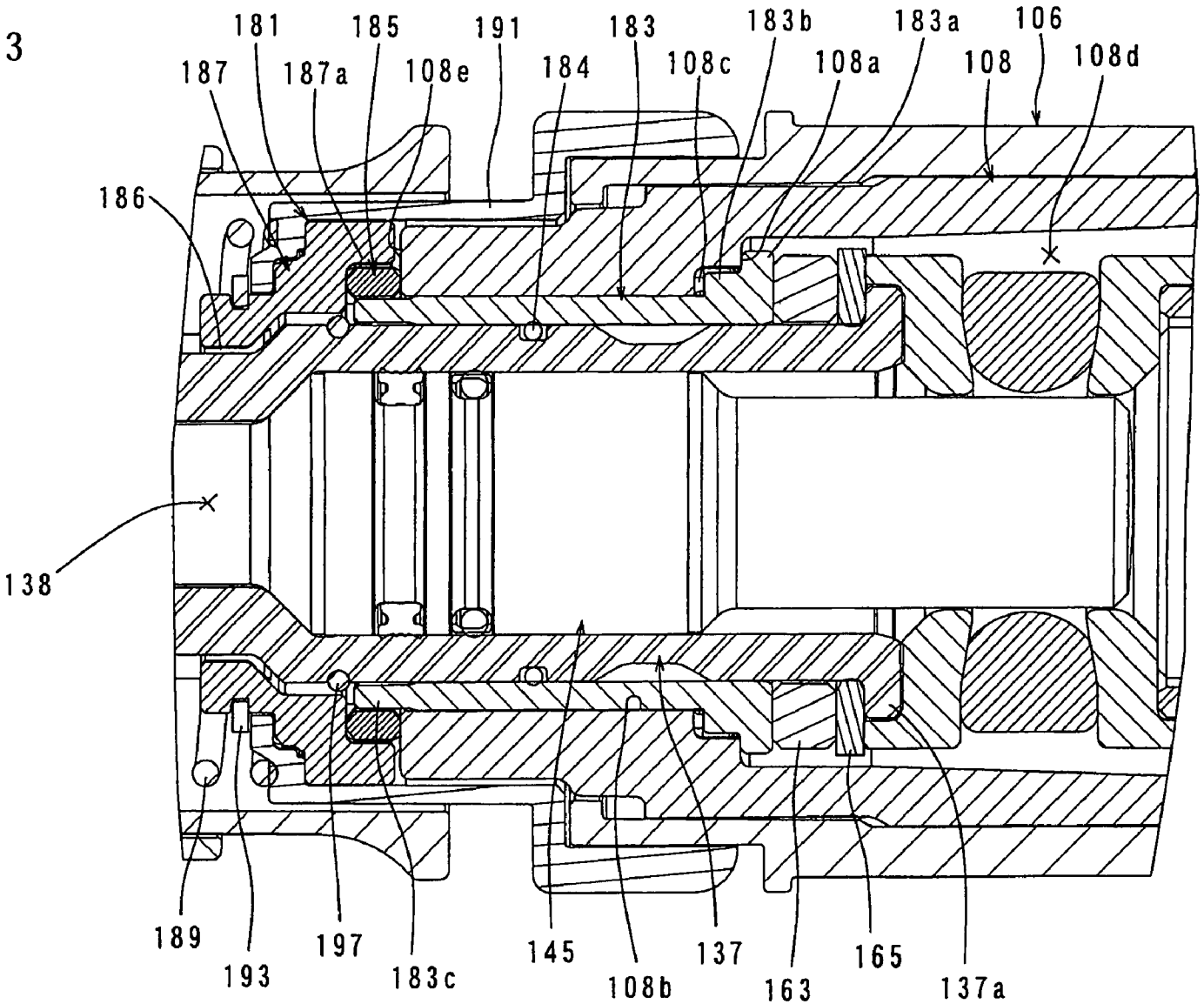
FIG. 3 is an enlarged sectional view showing the structure of an angular positioning device in a rotation prevented state or positioned state of a tool holder.
Figure 4:
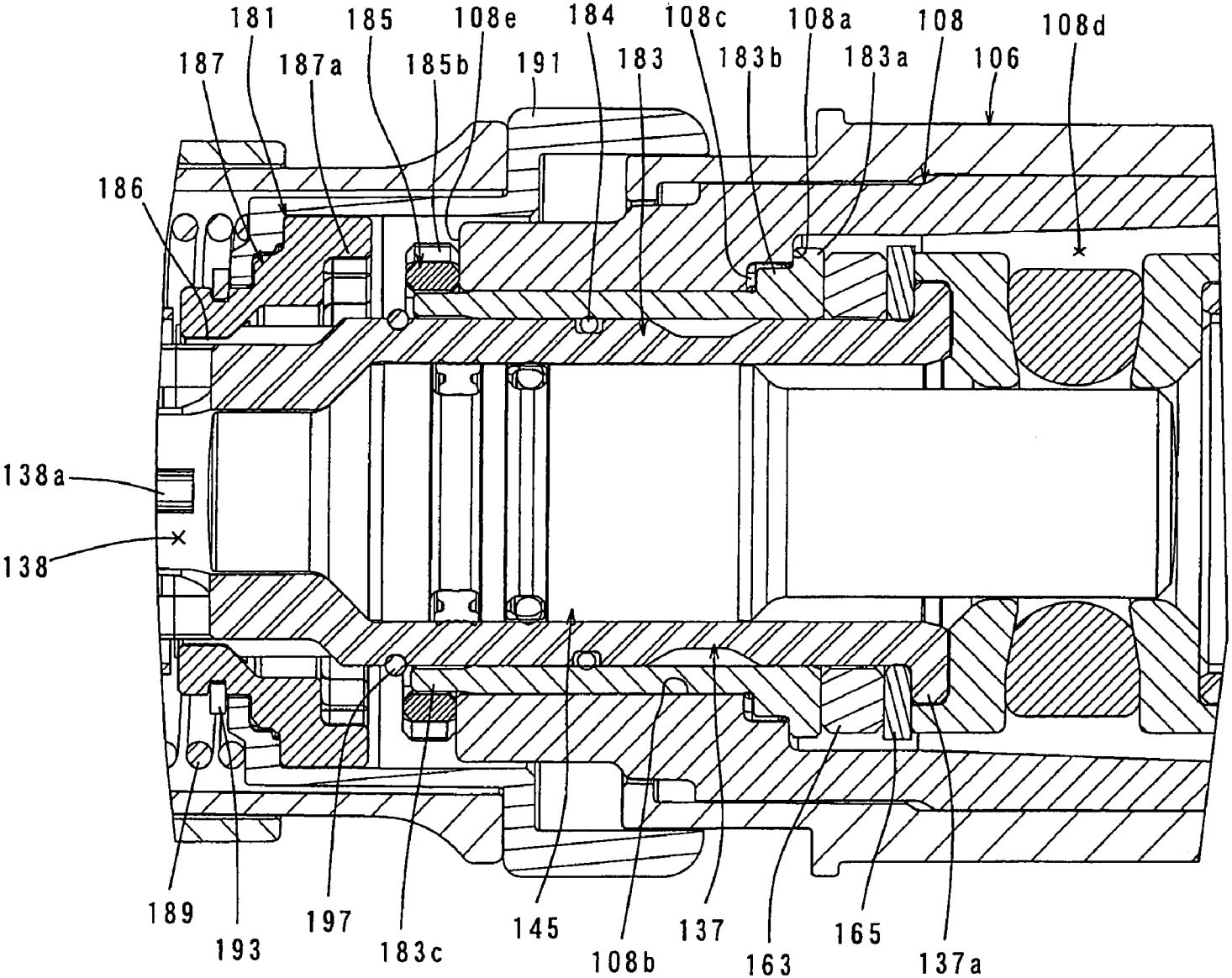
FIG. 4 is an enlarged sectional view showing the structure of the angular positioning device in a rotation allowed state of the tool holder.
Figure 5:
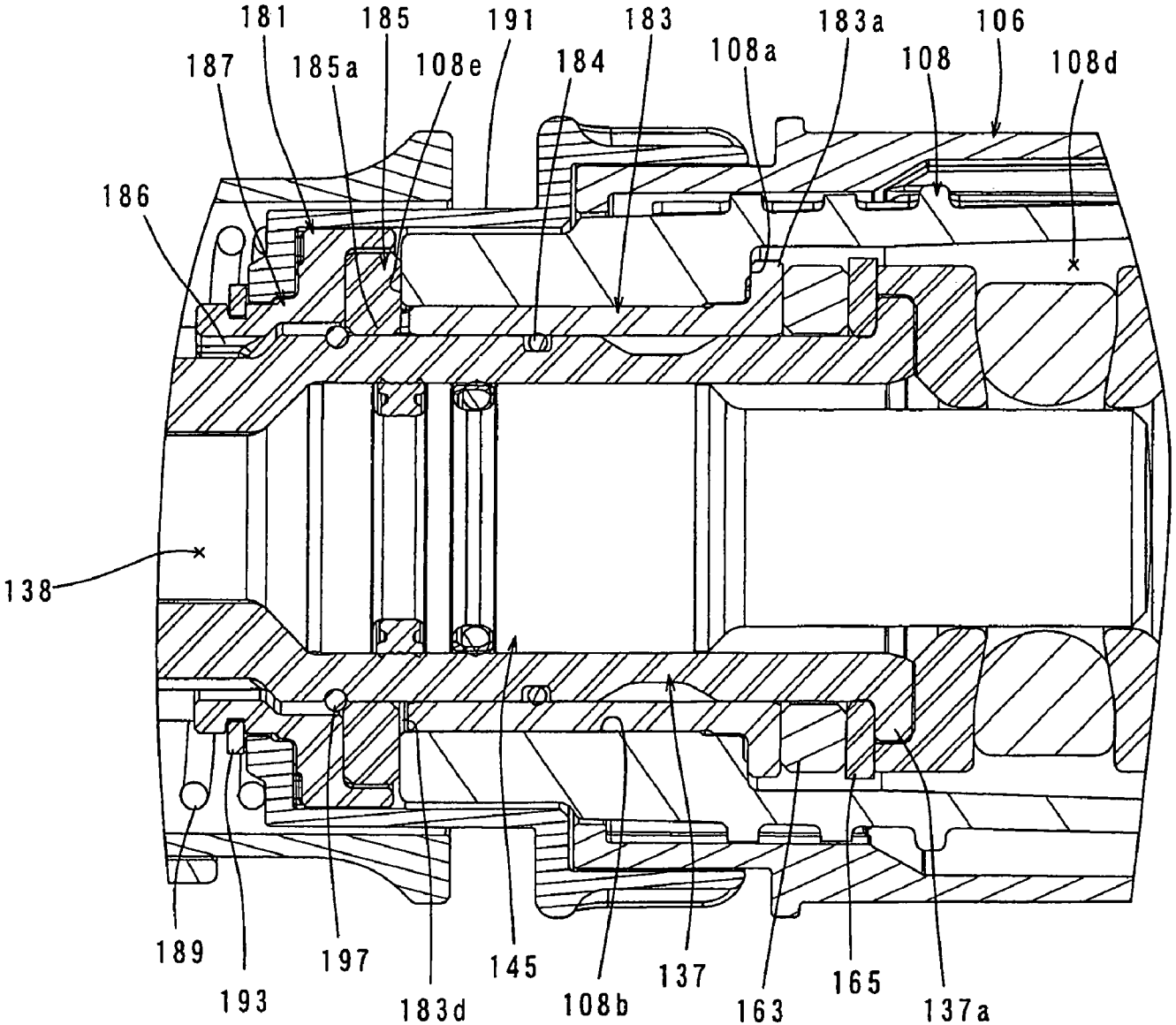
FIG. 5 is an enlarged sectional view showing the structure of the angular positioning device along a different line from the sectional views of FIGS. 3 and 4.

An embodiment of the invention is now described with reference to FIGS. 1 to 5. In this embodiment, an electric hammer is explained as a representative example of an impact tool according to the invention. FIG. 1 shows an entire structure of an electric hammer 101. FIG. 2 is an enlarged view showing the structure of an essential part of the electric hammer 101. FIGS. 3 to 5 are enlarged views showing the structure of an angular positioning device for positioning a hammer bit in its circumferential direction with respect to a tool body. FIG. 3 shows a rotation prevented state or positioned state of a tool holder, and FIG. 4 shows a rotation allowed state of the tool holder. FIG. 5 is a sectional view of the angular positioning device along a different line from the sectional views of FIGS. 3 and 4.

As shown in FIG. 1, the electric hammer 101 according to this embodiment includes a body 103 that forms an outer shell of the electric hammer 101, a tool holder 137 that is connected to a tip end region (on the left side as viewed in FIG. 1) of the body 103 in its longitudinal direction, a hammer bit 119 detachably coupled to the tool holder 137, and a handgrip 109 that is connected to the other end of the body 103 in its longitudinal direction (on the right side as viewed in FIG. 1) and designed to be held by a user. The body 103 and the hammer bit 119 are features that correspond to the "tool body" and the "tool bit", respectively, according to the invention. The hammer bit 119 is held by the tool holder 137 such that it is allowed to reciprocate with respect to the tool holder 137 in its axial direction (the longitudinal direction of the body 103) and prevented from rotating with respect to the tool holder 137 in its circumferential direction. For the sake of convenience of explanation, the side of the hammer bit 119 is taken as the front side and the side of the handgrip 109 as the rear side.

The body 103 mainly includes a motor housing 105 that houses a driving motor 111, a crank housing 107 that houses a motion converting mechanism 113, and a generally cylindrical barrel 108 that houses a striking mechanism 115. The motion converting mechanism 113 is adapted to appropriately convert the rotating output of the driving motor 111 to linear motion and then to transmit it to the striking mechanism 115. As a result, an impact force is generated in the axial direction of the hammer bit 119 via the striking mechanism 115. The barrel 108 in the form of a cylindrical housing is connected to the front end of the crank housing 107 and extends forward in the axial direction of the hammer bit 119. Further, the handgrip 109 is generally U-shaped having an open front and connected to the rear of the motor housing 105. A power switch 131 and an actuating member 133 are disposed in the upper region of the handgrip 109. The power switch 131 electrically drives the driving motor 111, and the actuating member 113 is slid by a user to actuate the power switch 113 between on and off positions.

The rotating output of the driving motor 111 is appropriately converted into linear motion via the motion converting mechanism 113 and transmitted to the striking mechanism 115. As a result, an impact force is generated in the axial direction of the hammer bit 119 via the striking mechanism 115. The driving motor 111 is arranged such that the axis of a motor shaft 112 crosses the axis of the hammer bit 119. The motion converting mechanism 113 and the striking mechanism 115 are features that correspond to the "driving mechanism" according to the invention.

The motion converting mechanism 113 serves to convert rotation of the driving motor 111 into linear motion and transmit it to the striking mechanism 115. The motion converting mechanism 113 is formed by a crank mechanism which includes a crank shaft 121 that is rotationally driven via a plurality of gears by the driving motor 111, a crank arm 123 that is connected to the crank shaft 121 via an eccentric pin at a position displaced from the center of rotation of the crank shaft 121 and a piston 125 that is caused to reciprocate via the crank arm 123. The piston 125 forms a driving element that drives the striking mechanism 115 and can slide within a cylinder 141 in the axial direction of the hammer bit 119. The crank mechanism is housed within a crank chamber 116 which is an enclosed housing space in a crank housing 107. A lubricant (grease) is sealed in the crank housing 107.

The striking mechanism 115 mainly includes a striking element in the form of a striker 143 that is slidably disposed within the bore of the cylinder 141, and an intermediate element in the form of an impact bolt 145 that is slidably disposed in the tool holder 137 and transmits the kinetic energy of the striker 143 to the hammer bit 119. An air chamber 141*a* is defined between the piston 125 and the striker 143 within the cylinder 141. The striker 143 is driven via the action of an air spring of the air chamber 141 a of the cylinder 141 which is caused by sliding movement of the piston 125. The striker 143 then collides with (strikes) the intermediate element in the form of the impact bolt 145 that is slidably disposed within the tool holder 137, and transmits the striking force to the hammer bit 119 via the impact bolt 145.

In the electric hammer 101 having the above-described construction, when the driving motor 111 is driven under loaded conditions in which the hammer bit 119 is pressed against the workpiece by the user's pressing force applied forward to the tool body 103 (as viewed in FIGS. 1 and 2), the piston 125 is caused to linearly slide along the cylinder 141 via the motion converting mechanism 113 that mainly comprises the crank mechanism. When the piston 125 slides, the striker 143 moves forward within the cylinder 141 by the action of the air spring of the air chamber 141*a* of the cylinder 141 and collides with the impact bolt 145. The kinetic energy of the striker 143 which is caused by the collision with the impact bolt 145 is transmitted to the hammer bit 119. Thus, the hammer bit 119 performs the hammering operation on a workpiece (concrete).

The tool holder 137 is provided such that it is allowed to rotate around the axis of the hammer bit with respect to the barrel 108. The hammer bit 119 is inserted into a bit holding hole 138 of the tool holder 137 from the front of the tool holder 137 and held by a bit holding device 136 disposed in the tip end region of the tool holder 137. The bit holding device 136 has an engagement member in the form of a plurality of engagement pawls 136*a* formed in the circumferential direction, and holds the hammer bit 119 via the engagement pawls 136*a* such that the hammer bit is prevented from being pulled out. The hammer bit 119 has axially extending grooves formed in its outer surface, and the grooves engage with a plurality of lugs 138*a* formed on an inner circumferential surface of the bit holding hole 138 and extending radially inward. Thus, the hammer bit 119 is prevented from rotating in the circumferential direction with respect to the tool holder 137. Specifically, the hammer bit 119 is held such that it is prevented from becoming detached from the tool holder 137 and also prevented from rotating in the circumferential direction with respect to the tool holder 137. The bit holding device 136 does not particularly relate to the invention, and thus explanation of its specific structure is omitted.

Next, an angular positioning device 181 is described with reference to FIGS. 2 to 5, which serves to fix the angular position of the hammer bit 119 held by the tool holder 137, around the axis or in the circumferential direction of the hammer bit 119. The angular positioning device 181 is disposed in a tip end region (on the front end side) of the barrel 108, and mainly includes a tool holder guide 183 in the form of a generally cylindrical member, a generally annular locking ring 185 for securing the positioning and a generally cup-like changing ring 187. The tool holder guide 183 holds the tool holder 137 in such a manner that the tool holder 137 can rotate around the axis of the hammer bit, and the tool holder guide 183 is normally connected to the barrel 108 in such a manner that it cannot rotate with respect to the barrel 108. The locking ring 185 for securing the positioning is normally connected to the tool holder guide 183 in such a manner that it cannot rotate with respect to the tool holder guide 183. The changing ring 187 prevents the tool holder 137 from rotating when the changing ring 187 is connected to the locking ring 185, while it allows the tool holder 137 to rotate when it is disconnected from the locking ring 185. The tool holder guide 183, the changing ring 187 and the locking ring 187 are features that correspond to the "first locking member", the "second locking member" and the "third locking member", respectively, according to the invention.

The barrel 108 is made of nonferrous metals such as an aluminum alloy and a synthetic resin in order to realize weight reduction, and has a circular tool holder holding hole 108*b* having a predetermined length in the axial direction of the hammer bit on the tip end side of the barrel 108. The tool holder guide 183 is a cylindrical member made of iron and fitted into the tool holder holding hole 108*b* of the barrel 108 from the rear (from the right as viewed in the drawings). Then, the tool holder 137 is inserted into the bore of the tool holder guide 183 from the rear. Specifically, the tool holder guide 183 is disposed between the tool holder 137 and the barrel 108. The tool holder guide 183 has a flange 183*a* extending radially outward from the axial rear end of the tool holder guide 183, and a plurality of pawls 183*b* formed on the front of the flange 183*a* at predetermined intervals in the circumferential direction. The pawls 183*b* of the tool holder guide 183 engage with a plurality of grooves 108*c* which are formed in the circumferential direction in the inner wall surface of the barrel on the rear end side of the tool holder holding holes 108*b* and designed and arranged to correspond to the pawls 183*b*. Thus, the tool holder guide 183 is normally held connected to the barrel 108 in such a manner as to be prevented from moving in the circumferential direction with respect to the barrel 108.

An inner space 108*d* is defined in the rear of the tool holder holding hole 108*b* of the barrel 108 and houses the cylinder 141 and an impact absorption mechanism 135 for absorbing an impact during an idle driving movement of the striker 143. Further, the inner space 108*d* is filled with lubricating oil. Therefore, the tool holder guide 183 is connected to the barrel 108 in lubricating oil within the inner space 108*d*. The inner space 108*d* is a feature that corresponds to the "housing space" according to the invention. An O-ring 184 is disposed between the mating surfaces of the tool holder 137 and the tool holder guide 183, so that the lubricating oil is prevented from leaking out of the inner space 108*d* through a clearance between the mating surfaces.

The tool holder 137 is made of iron and has a flange 137*a* extending radially outward from the axial rear end of the tool holder 137. Further, a rubber ring 163 and a flat washer 165 of the impact absorption mechanism 135 are disposed between the flange 137*a* of the tool holder 137 and the flange 183*a* of the tool holder guide 183. Specifically, the flange 183*a* of the tool holder guide 183 is held between the rubber ring 163 and an engagement surface 108*a* which is formed in the barrel 108 in a direction transverse to the axial direction, so that it is locked against axial movement. As a result, the tool holder guide 183 is held connected to the barrel 108. The impact absorption mechanism 135 does not particularly relate to the invention, and thus explanation of its specific structure is omitted.

The axial front end 183*c* of the tool holder guide 183 protrudes a predetermined extent forward from the front end of the barrel 108, and a plurality of grooves 183*d* (see FIG. 5) are formed in the protruding front end 183*c* at appropriate intervals in the circumferential direction. The iron locking ring 185 is fitted on the front end 183*c* of the tool holder guide 183. A plurality of radially extending pawls 185*a* are formed on the inner circumferential surface of the locking ring 185 in the circumferential direction and designed and arranged to correspond to the grooves 183*d* of the front end 183*c*. The pawls 185*a* engage with the grooves 183*d* of the front end 183*c* (see FIG. 5). Thus, the tool holder guide 183 is normally connected to the locking ring 185 in such a manner that it cannot move in the circumferential direction. Further, a plurality of positioning grooves (recesses) 185*b* are formed in the outer circumferential surface of the locking ring 185 at equal intervals in the circumferential direction (see FIG. 4).

A stopper ring 197 is fitted on the tool holder 137 at a position adjacent to the front end of the tool holder guide 183 and disposed opposite to a front end surface of a radially inward portion of each of the pawls 185*a* of the locking ring 185 in such a manner that it can contact this front end surface (see FIG. 5). Further, the locking ring 185 is held in contact with the front end surface 108*e* extending in a direction transverse to the axial direction of the barrel 108. Therefore, the locking ring 185 serves as a stopper for preventing the tool holder 137 from moving rearward (to the inner space 108*d* side of the barrel 108) when the tool holder 137 is mounted to the barrel 108.

The changing ring 187 is made of iron and mounted on the tool holder 137 in front of the locking ring 185. The changing ring 187 is mounted onto the tool holder 137 via a spline fit 186 between a front small-diameter portion of the changing ring 187 and the tool holder 137, so that the changing ring 187 can move in the axial direction and cannot rotate in the circumferential direction with respect to the tool holder 137. A plurality of positioning pawls 187*a* are formed on a rear end surface of the changing ring 187 which is opposed to the locking ring 185, at equal intervals in the circumferential direction, and designed and arranged to correspond to the positioning grooves 185*b* of the locking ring 185. When the changing ring 187 is moved rearward toward the locking ring 185, the pawls 187*a* of the changing ring 187 engage with the positioning grooves 185*b* of the locking ring 185. Thus, the changing ring 187 is connected to the locking ring 185 in such a manner that it cannot move in the circumferential direction with respect to the locking ring 185. As a result, the changing ring 187 as well as the tool holder 137 is prevented from rotating. On the other hand, when the changing ring 187 is moved forward away from the locking ring 185, the pawls 187*a* are disengaged from the grooves 185*b* of the locking ring 185 and the changing ring 187 as well as the tool holder 137 is allowed to rotate. The positioning grooves 185*b* and the positioning pawls 187*a* are features that correspond to the "projections and recesses" according to the invention.

Specifically, the changing ring 187 can be moved in the axial direction between a rotation prevented position in which the tool holder 137 is prevented from rotating by engagement of the pawls 187*a* with the grooves 185*b* of the locking ring 185 and a rotation allowed position in which the tool holder 137 is allowed to rotate by disengagement of the pawls 187*a* from the grooves 185*b* of the locking ring 185. Further, the changing ring 187 is biased to the rotation prevented position by a biasing member in the form of a coil spring 189 and holds the tool holder 137 in the rotation prevented state unless acted upon by an external force for moving the changing ring 187 to the rotation allowed position.

An operating member in the form of an operating sleeve 191 is coupled to the changing ring 187 and operated to move the changing ring 187 between the rotation prevented position and the rotation allowed position. A front end of the operating sleeve 191 is mounted on the changing ring 187 via a stopper ring 193, so that the operating sleeve 191 is prevented from moving in the axial direction and rotating in the circumferential direction with respect to the changing ring 187. Specifically, the operating sleeve 191 is integrated with the changing ring 187 and its rear end side is exposed on a barrel cover 106 for covering the barrel 108 so that the operating sleeve 191 can be operated by the user from outside. Further, the coil spring 189 is disposed between the front end surface of the operating sleeve 191 and a spring receiver 195 which is disposed within the above-described bit holding device 136 in the tip end region of the tool holder 137, and applies a biasing force to the operating sleeve 191 and the changing ring 187 toward the rotation prevented position.

Operation of the angular positioning device 181 having the above-described construction according to this embodiment is now explained. In order to fix the circumferential position of the hammer bit 119 with respect to the barrel 108, the user moves the operating sleeve 191 forward by hand against the biasing force of the coil spring 189 and moves the changing ring 187 to the rotation allowed position. Thus, the pawls 187*a* of the changing ring 187 are disengaged from the grooves 185*b* of the locking ring 185, so that the tool holder 137 is allowed to rotate with respect to the barrel 108 (the tool holder guide 183) or released from the fixedly positioned state. Next, when the user turns the operating sleeve 191 in the circumferential direction in this released state, the tool holder 137 is rotated together with the changing ring 187 integrated with the operating sleeve 191, which in turn causes the hammer bit 119 and the bit holding device 136 to rotate together with the tool holder 137. In this manner, the circumferential position of the hammer bit 119 with respect to the barrel 108 is fixed. Thereafter, when the changing ring 187 is moved to the rear rotation prevented position together with the operating sleeve 191, the pawls 187*a* engage with the grooves 185*b* of the locking ring 185 again. Thus, the hammer bit 119, the bit holding device 136 and the tool holder 137 are prevented from rotating in the circumferential direction with respect to the barrel 108 and locked in the fixed angular position.

With the angular positioning device 181 according to this embodiment, the user can perform the angular positioning of the hammer bit 119 in its circumferential direction by operating the operating sleeve 191 by one hand, while, for example, holding the barrel 108 by the other hand, so that positioning of the hammer bit 119 can be performed without impairing the operability of the known angular positioning device.

The angular positioning device 181 according to this embodiment is disposed in the tip end region of the barrel 108. The tip end region of the barrel 108 is located in the vicinity of the hammer bit 119 to be positioned, so that the user can operate the operating sleeve 191 in the vicinity of the hammer bit 119. Therefore, the angular positioning device 181 having higher operability is provided. On the other hand, the angular positioning device 181 disposed in the tip end region of the barrel 108 is exposed to dust which is generated during hammering operation. As a result, a connection which is formed by a sliding part in the angular positioning device 181 is caused to be susceptible to wear under the influence of dust. If all of the members of the angular positioning device which have a connection are formed of wear-resistant materials such as iron in order to overcome this problem of wear, the electric hammer 101 will increase in weight.

In this embodiment, the tool holder guide 183 is disposed between the tool holder 137 and the barrel 108 in such a manner that it extends into the inner space 108*d* of the barrel 108 and is connected to the barrel 108 in oil within the inner space 108*d*. With such construction, this connection can be avoided from being adversely affected by dust and can be protected by the lubricant. Therefore, the barrel 108 which has a relatively large volume among the component parts relating to the angular positioning device 181 is formed from nonferrous materials such as an aluminum alloy, in order to reduce the weight of the electric hammer 101 while reducing wear. The tool holder guide 183, the locking ring 185 and the changing ring 187 are formed from wear-resistant materials such as ferrous materials, so that their durability can be enhanced.

In assembly of the electric hammer 101, at least the tool holder guide 183, the tool holder 137, the locking ring 185, the rubber ring 163 and the flat washer 165 are mounted to the barrel 108 prior to mounting of the barrel 108 to the crank housing 107. This mounting operation is performed, for example, in the following procedure. Firstly, the tool holder guide 183 is inserted into the tool holder holding holes 108*b* of the barrel 108 from the rear, and then the tool holder 137 on which the flat washer 165 and the rubber ring 163 are mounted in advance is inserted into the bore of the tool holder guide 183 from the rear. Subsequently, the locking ring 185 is fitted onto the outer periphery of the front end 183*a* of the tool holder guide 183, and finally, the stopper ring 197 is fitted onto the tool holder 137. The stopper ring 197 is held in contact with the front end surface of the radially inward portion of each of the pawls 185*a* of the locking ring 185, so that the tool holder 137 mounted to the barrel 108 in the above-described manner is prevented from becoming dislodged. Specifically, according to this embodiment, the locking ring 185 can be provided with a function as a stopper for preventing the tool holder 137 from becoming dislodged, as well as a function for positioning the tool holder 137 in its circumferential direction. Thus, a plurality of component parts are mounted to the barrel 108 in advance in order to form an assembly, and in this assembled state, the barrel 108 can be mounted to the crank housing 107, so that ease of assembly can be enhanced.

Further, in this embodiment, the locking ring 185 is disposed between the tool holder guide 183 and the changing ring 187, but it may be altered such that the changing ring 187 is directly connected to and disconnected from the tool holder guide 183 without providing the locking ring 185. Further, in this embodiment, the electric hammer 101 is described as an example of a representative impact tool in which the hammer bit 119 performs only a striking movement in the axial direction. However, the invention can also be applied to a hammer drill in which the hammer bit 119 performs a striking movement in the axial direction and a rotation in the circumferential direction, for example, by additionally providing the angular positioning device 181 with a means for locking the changing ring 187 in a rotation allowed position in which the tool holder 137 is allowed to rotate.

Second Representative Embodiment

Figure 6:
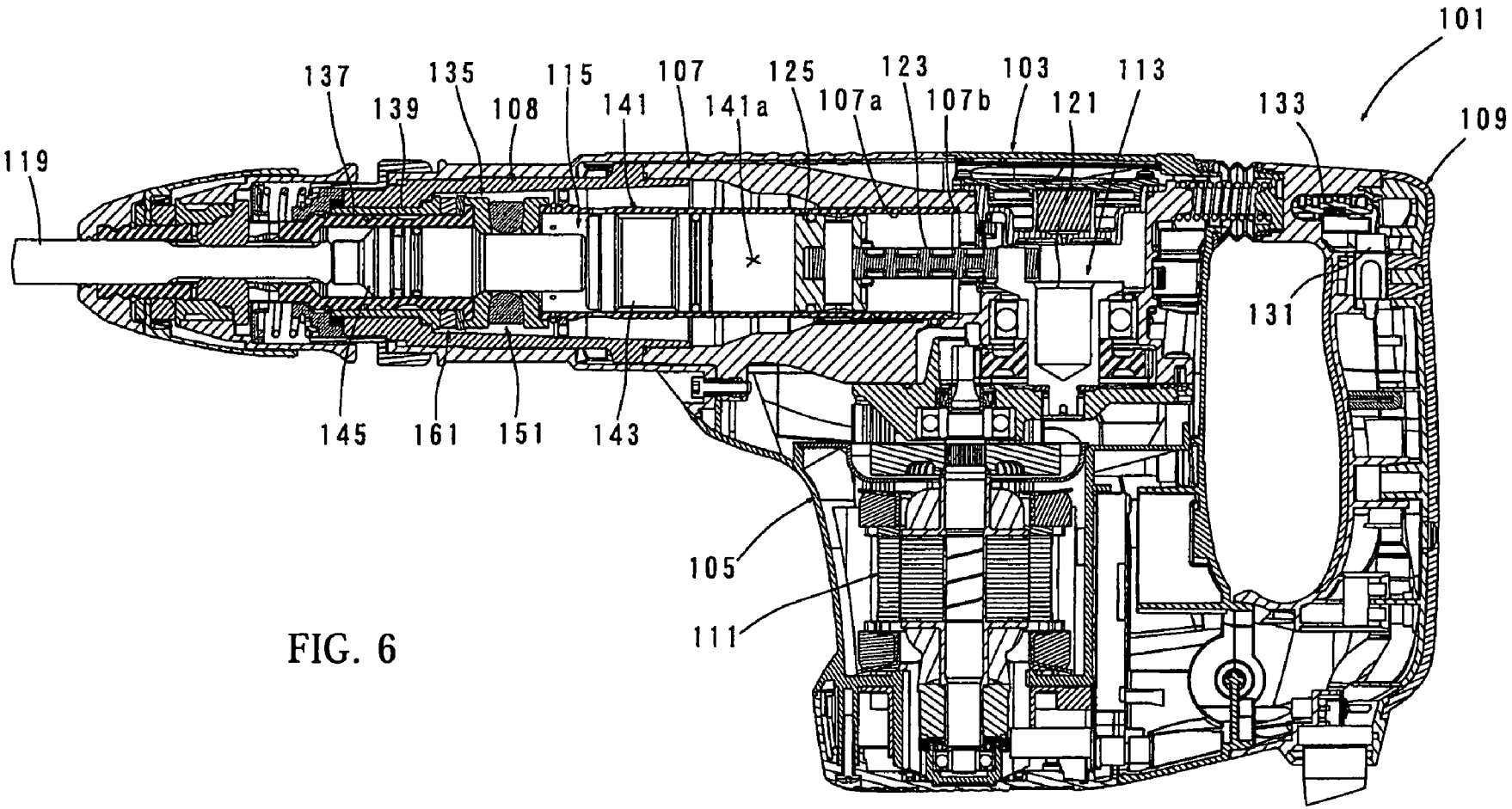
FIG. 6 is a sectional view schematically showing an entire electric hammer according to an embodiment of this invention.
Figure 7:
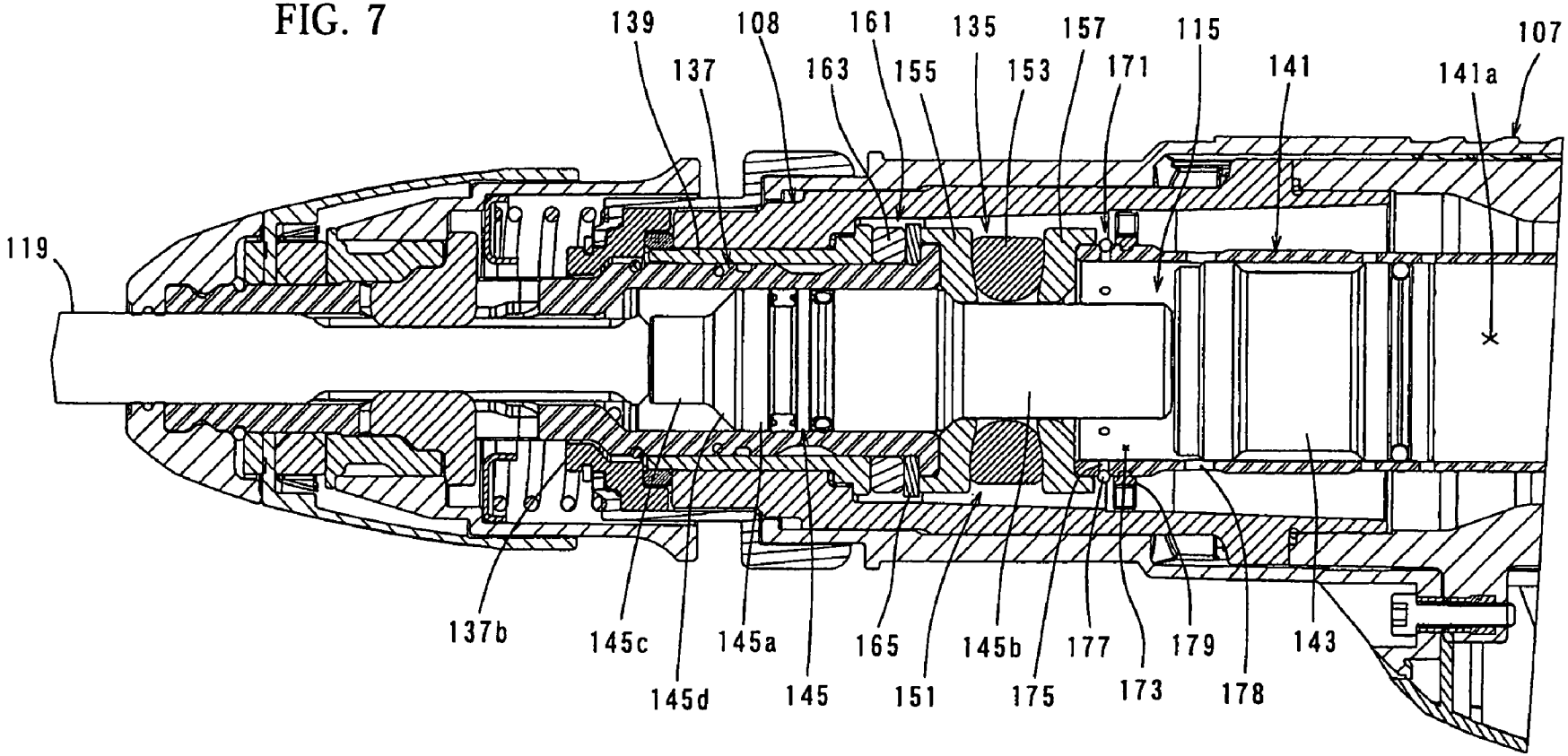
FIG. 7 is a sectional view showing an essential part of the electric hammer during normal striking movement.
Figure 8:
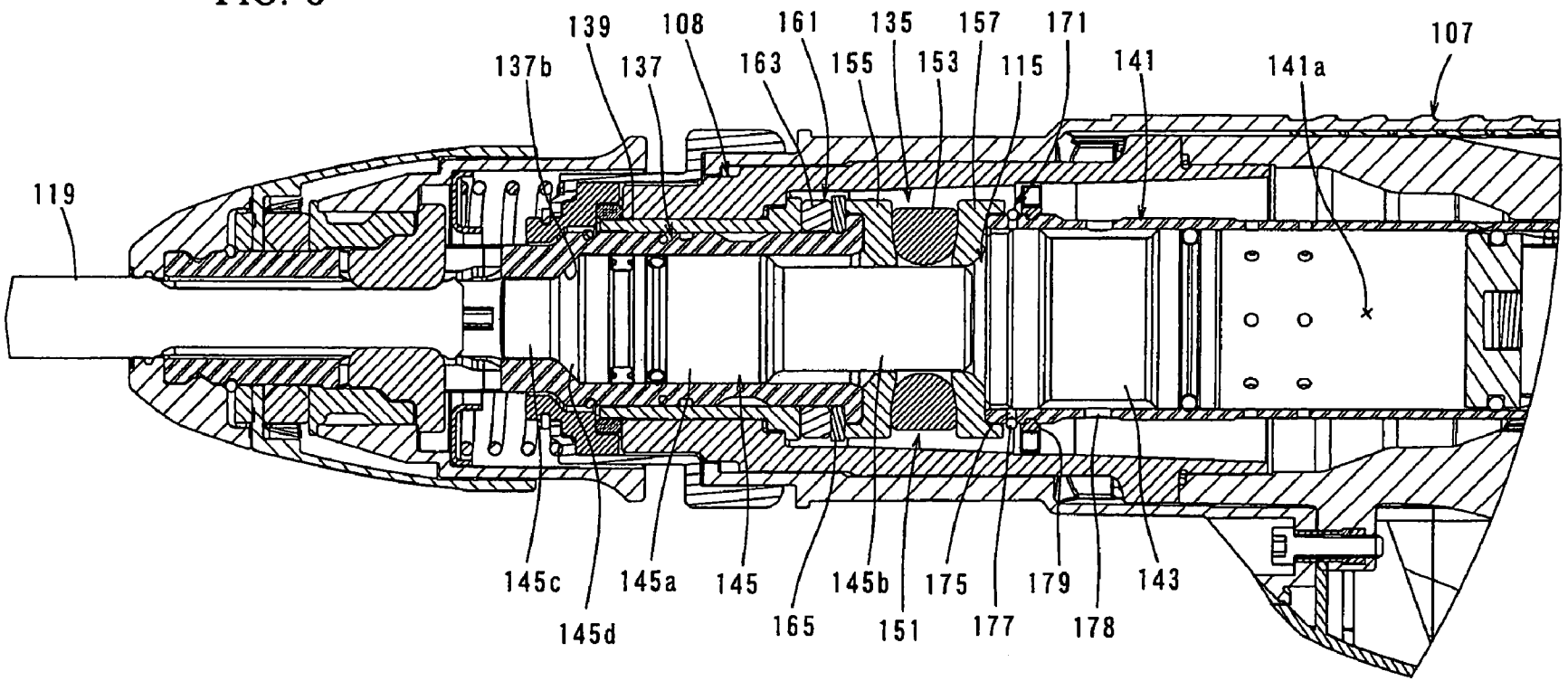
FIG. 8 is a sectional view showing the essential part of the electric hammer during idle driving movement.
Figure 9:
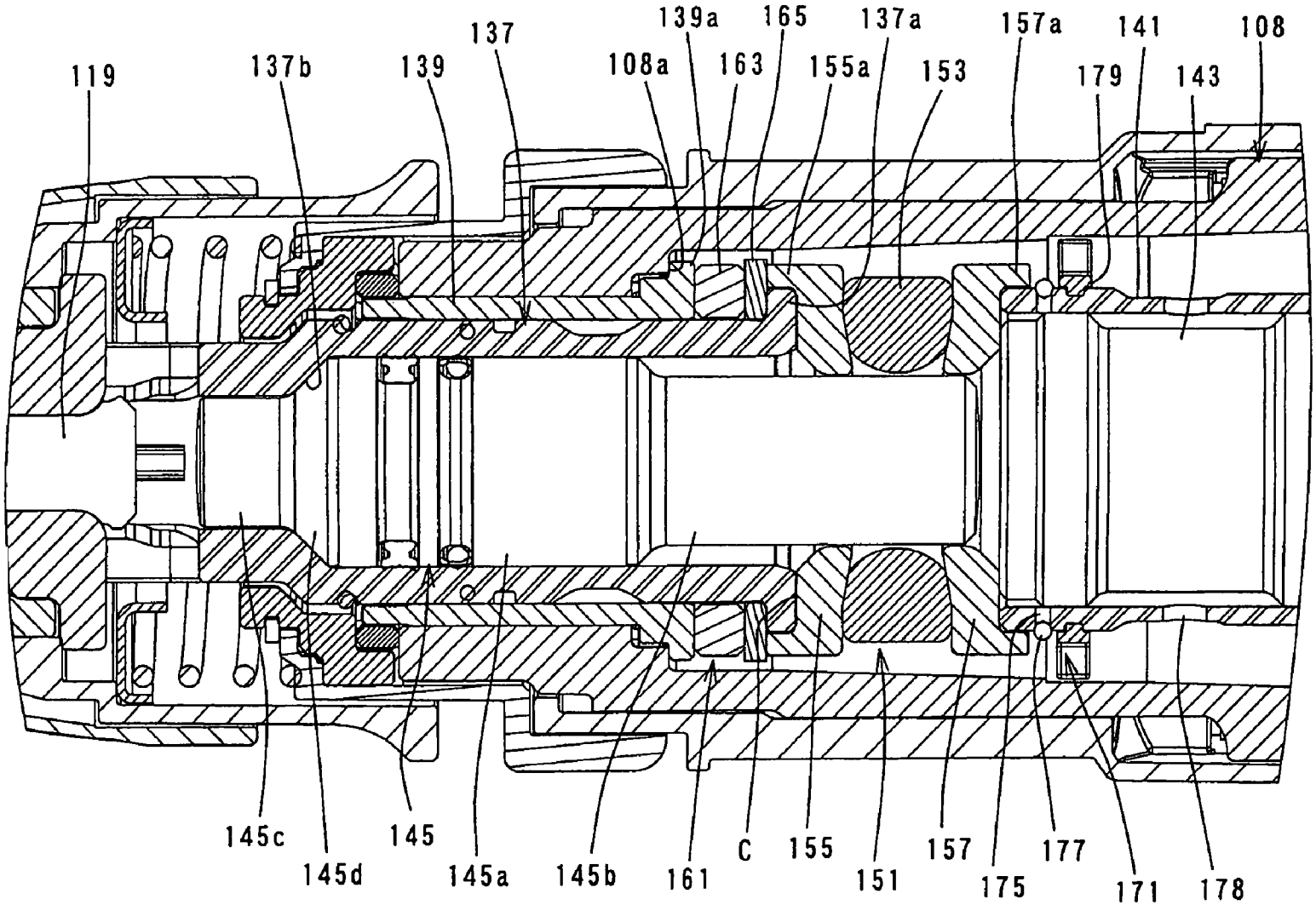
FIG. 9 is a partially enlarged view of FIG. 3.

Second representative embodiment of the invention is now described with reference to FIGS. 6 to 9. In this embodiment, an electric hammer is explained as a representative example of an impact tool according to the invention. FIG. 6 shows an entire structure of an electric hammer 101. FIGS. 7 and 8 show the structure of an essential part of the electric hammer according to the invention. FIG. 9 is a partially enlarged view of FIG. 8. The electric hammer according to the second representative embodiment has substantially the same construction with the electric hammer. In this connection, detailed explanation of same features with the first representative embodiment is abbreviated.

When the user stops applying the pressing force against the workpiece to the hammer bit 119 in order to finish the hammering operation, the striker 143 performs an idle driving movement, or the striking movement under unloaded conditions in which no load is applied to the hammer bit 119. During this idle driving movement, the striker 143 collides with the impact bolt 145 under loaded conditions. In other words, the striker 143 moves further forward beyond a striking position at which the striker strikes the impact bolt. In order to absorb the impact caused by the idle driving movement of the striker 143, an impact absorption mechanism 135 is provided within the barrel 108 on the front end side. The impact absorption mechanism 135 mainly includes a rear cushioning member 151 and a front cushioning member 161 which are disposed side by side in the axial direction of the hammer bit 119.

FIGS. 7 to 9 show the impact absorption mechanism 135. As shown in FIGS. 7 to 9, the rear cushioning member 151 mainly includes an elastically deformable first rubber ring 153 and metallic front and rear stepped sleeves 155, 157 between which the first rubber ring 153 is held. The rear cushioning member 151 is disposed on the rear small-diameter portion 145*b* of the impact bolt 145. The first rubber ring 153 and the front and rear stepped sleeves 155, 157 are features that correspond to the "first elastic element" and the "first receiving portion", respectively, according to this invention. Annular portions 155*a*, 157*a* are formed on radially outer edges of the front and rear stepped sleeves 155, 157, respectively, and extend in the axial direction of the hammer bit such that the stepped sleeves 155, 157 are symmetrically formed. Specifically, the annular portion 155*a* of the front stepped sleeve 155 extends forward and the annular portion 157*a* of the rear stepped sleeve 157 extends rearward. The annular portions 155*a*, 157*a* are features that correspond to the "protrusion" according to this invention. The rear stepped sleeve 157 is arranged such that its rear surface is held in contact with the front end surface of the cylinder 141 and the annular portion 157*a* is fitted over the cylinder 141. The front stepped sleeve 155 is arranged such that it is held in contact with a radially outward portion of a rear surface of a flat washer 165 of the front cushioning member 161 which is described below in detail.

The front cushioning member 161 mainly includes an elastically deformable second rubber ring 163, a metallic flat washer 165 disposed at the rear of the second rubber ring 163, and a tool holder 137. The second rubber ring 163 and the flat washer 165 are disposed on a rear end portion of the generally cylindrical tool holder 137. The second rubber ring 163 and the tool holder 137 are features that correspond to the "second elastic element" and the "second receiving portion", respectively, according to this invention. A generally cylindrical tool holder guide 139 is disposed between the outer surface of the tool holder 137 and the inner surface of the barrel 108, and the second rubber ring 163 is held in contact with a rear end surface of the tool holder guide 139. The tool holder guide 139 has a flange 139*a* extending radially outward from its axial rear end, and the flange 139*a* is held in contact with a radial engagement surface 108*a* formed in the inner wall of the barrel 108. Thus, the tool holder guide 139 is prevented from moving forward with respect to the barrel 108. The tool holder guide 139 is a feature that corresponds to the "member on the tool body side" according to this invention. The tool holder 137 has a flange 137*a* extending radially outward from the axial rear end of the tool holder 137, and the flange 137*a* is held in contact with a radially inward portion of the rear surface of the flat washer 165.

Specifically, the annular portion 155*a* of the front stepped sleeve 155 of the rear cushioning member 151 and the flange 137*a* of the tool holder 137 of the front cushioning member 161 are disposed side by side in contact with the radially outward and inward portions of the rear surface of the flat washer 165, respectively. Therefore, an impact on the striker 143 side and an impact on the impact bolt 145 side which are caused during the idle driving movement of the striker 143 are transmitted (inputted) to the flat washer 165 in parallel. Further, the thickness (longitudinal extent) of the flange 137*a* is designed to be smaller than the protruding extent of the annular portion 155*a* of the front stepped sleeve 155, so that a predetermined clearance C is defined between a rear surface of the flange 137*a* and a front surface of the front stepped sleeve 155 which are opposed to each other.

In the impact absorption mechanism 135 having the above-described construction according to this embodiment, the second rubber ring 163, the flat washer 165, the flange 137*a* of the tool guide 137, the front stepped sleeve 155, the first rubber ring 153 and the rear stepped sleeve 157 are arranged in series in the axial direction of the hammer bit in this order from the tool holder guide 139 side or from the front between the rear surface of the flange 139*a* of the tool holder guide 139 and the front end surface of the cylinder 141. Further, the impact absorption mechanism 135 is installed with the first and second rubber rings 153, 163 preloaded in the axial direction of the hammer bit.

The impact bolt 145 has a stepped, columnar form having a large-diameter portion 145*a* that is slidably held by the tool holder 137, a front small-diameter portion 145*c* formed at the front of the large-diameter portion 145*a*, a rear small-diameter portion 145*b* formed at the rear of the large-diameter portion 145*a*, and a front tapered surface 145*d* between the large-diameter portion 145*a* and the front small-diameter portion 145*c*. The impact bolt 145 is prevented from moving further forward by contact of the front tapered surface 145*d* with a stopper in the form of an inner wall tapered surface 137*b* of the tool holder 137. The rear small-diameter portion 145*b* of the impact bolt 145 protrudes rearward from the rear end of the tool holder 137 and faces a front bore space 173 of the cylinder 141. The rear end surface of the rear small-diameter portion 145*b* of the impact bolt 145 is retracted from the rear surface of the rear stepped sleeve 157 into the bore or moved away from the front end surface (striking face) of the striker 143 when the impact bolt 145 is moved to a forward end position (a position in which the front tapered surface 145*d* comes into contact with the inner wall tapered surface 137*b* of the tool holder 137).

In the impact absorption mechanism 135 having the above-described construction according to this embodiment, when an idle driving movement of the striker 143 is performed under the unloaded conditions in which the user stops pressing the hammer bit 119 against the workpiece in order to finish the hammering operation, the striker 143 moves further forward beyond a proper striking position. When the striker 143 moves forward beyond the striking position and comes into contact with the rear surface of the rear stepped sleeve 157, as shown in FIGS. 8 and 9, the kinetic energy of the striker 143 is transmitted to the barrel 108 via the rear stepped sleeve 157, the first rubber ring 153, the front stepped sleeve 155, the annular portion 155*a* of the front stepped sleeve 155, the flat washer 165, the second rubber ring 163 and the tool holder guide 139. In this process, the kinetic energy is absorbed by elastic deformation of the first rubber ring 153 and the second rubber ring 163 in the transmission path. Specifically, the impact caused by contact of the striker 143 with the rear surface of the rear stepped sleeve 157 is absorbed by elastic deformation of the first rubber ring 153 and the second rubber ring 163.

Further, when the striker 143 applies a striking force to the impact bolt 145 during further forward movement beyond the striking position, the impact bolt 145 moves forward and the front tapered surface 145*d* contacts the inner wall tapered surface 137*b* of the tool holder 137. Therefore, the kinetic energy of the impact bolt 145 is transmitted to the barrel 108 via the flange 137*a* of the tool holder 137, the flat washer 165, the second rubber ring 163 and the tool holder guide 139 and absorbed by elastic deformation of the second rubber ring 163 in this transmission path. Specifically, the impact caused by contact of the impact bolt 145 with the tool holder 137 is absorbed by elastic deformation of the second rubber ring 163.

Thus, in the impact absorption mechanism 135 according to this embodiment, the impact caused by the idle driving movement of the striker 143 is absorbed by the first rubber ring 153 and the second rubber ring 163, so that the impact can be prevented from being transmitted to the barrel 108.

According to this embodiment, the impact caused by contact of the striker 143 with the rear stepped sleeve 157 is received not only by the first rubber ring 153, but also by the second rubber ring 163 which serves to receive an impact from the impact bolt 145. Specifically, the first rubber ring 153 and the second rubber ring 163 can share the impact. Therefore, the load applied on the first rubber ring 153 and the second rubber ring 163 can be alleviated, so that their durability can be improved. Particularly, in this embodiment, impacts from the striker 143 and the impact bolt 145 are transmitted to the second rubber ring 163 in parallel. With this construction, the impact on the striker 143 side can be effectively transmitted to the second rubber ring 163, regardless of timing of contact of the striker 143 with the rear stepped sleeve 157 and contact of the impact bolt 145 with the tool holder 137.

Further, in the electric hammer 101 according to this embodiment, an idle driving prevention mechanism 171 for preventing the striker 143 from repeating idle driving movement is provided in a front end region (tip end region) of the cylinder 141. When the striker 143 moves further forward beyond the striking position at which the striker 143 strikes the hammer bit 119, under unloaded conditions in which the hammer bit 119 is not pressed against the workpiece, the idle driving prevention mechanism 171 prevents the striker 143 from moving back to a pre-striking position (a position at which the striker 143 is placed before striking), so that the striker 143 can be prevented from repeating idle driving movement. The idle driving prevention mechanism 171 mainly includes the front bore space 173 of the cylinder 141, a plurality of air vents 175 which provide communication between the inside and the outside of the front bore space 173, and an elastically deformable O-ring 177 which serves as a non-return valve for opening and closing the air vents 175.

The front bore space 173 is defined as a space which is enclosed by the bore inner wall surface of the cylinder 141, the front surface of the striker 143, the rear surface of the impact bolt 145 and the rear surface of the rear stepped sleeve 157. A plurality of the air vents 175 are formed radially through the cylinder 141 and arranged on the same circumference. The air vents 175 are normally closed by the O-ring 177 fitted on the outer circumferential surface of the cylinder 141. An opening 178 is formed in the cylinder 141 rearward of the air vents 175 and has a larger cross-sectional area than the air vents 175. The opening 178 is formed at a position in which it is closed by the periphery of the striker 143 when the striker 143 moves forward beyond the striking position.

When the striker 143 moves forward beyond the striking position and closes the opening 178, air within the front bore space 173 is compressed by the further forward movement of the striker 143 and then escapes to the outside through the air vents 175 while pushing the O-ring 177 outward. Thereafter, when the striker 143 tries to move back to the pre-striking position by suction force of the air chamber 141 a of the cylinder 141, a negative pressure is caused in the front bore space 173 because the O-ring 177 prevents inflow of outside air. As a result, the striker 143 is prevented from moving back and held in a position forward of the striking position. Thus, the striker 143 is prevented from repeating idle driving movement.

In this embodiment, the annular portion 157*a* of the rear stepped sleeve 157 is disposed opposite to the front of the O-ring 177. Therefore, when the air within the front bore space 173 escapes to the outside through the air vents 175, the annular portion 157*a* prevents the O-ring 177 from moving forward in the axial direction. Thus, the O-ring 177 can be prevented from being displaced forward in the axial direction. Further, in order to prevent the O-ring 177 from being displaced rearward in the axial direction, an O-ring guide 179 is provided on the cylinder 141 rearward of the O-ring 177 and prevents the O-ring 177 from moving reward. As a result, return of the O-ring 177 to its initial position (closing position) is ensured.

Further, in this embodiment, the first rubber ring 153 and the second rubber ring 163 are mounted under a predetermined pre-load (in a pressed state). Therefore, the cylinder 141 can be held pressed against the radial engagement surface 107*b* of the bore 107*a* of the crank housing 107 by the elastic forces of the first rubber ring 153 and the second rubber ring 163. Therefore, a securing member (O-ring) for securing the cylinder 141 within the bore 107*a* of the crank housing 107 can be omitted. Further, rattling of the cylinder 141 can be suppressed, so that vibration of the electric hammer 101 can be lowered.

Further, as described above, by the elastic forces of the first rubber ring 153 and the second rubber ring 163, closer contact can be achieved between the contact surfaces of the cylinder 141 and the rear stepped sleeve 157, between the contact surfaces of the tool holder guide 139 and the second rubber ring 163 and between the contact surfaces of the component parts of the impact absorption mechanism 135. As a result, sealing performance of sealing the front bore space 173 are enhanced, so that the efficiency of the idle driving prevention mechanism 171 can be improved. Further, in this embodiment, the front stepped sleeve 155 and the rear stepped sleeve 157 have the same shape and are disposed in symmetry on the both sides of the first rubber ring 153. Therefore, proper installation of the front and rear stepped sleeves 155, 157 is ensured, so that ease of installation can be improved. Further, advantageously, the annular portion 155*a* of the front stepped sleeve 155 can be utilized as a member for transmitting an impact, and the annular portion 157*a* of the rear stepped sleeve 157 as a member for preventing displacement of the non-return valve in the form of the O-ring 177.

Further, in this embodiment, the electric hammer is described as a representative example of the impact tool. However, the invention can also be applied to a hammer drill in which the hammer bit 119 performs a linear striking movement and a rotation in the circumferential direction.

DESCRIPTION OF NUMERALS

101 electric hammer (impact tool)
103 body (tool body)
105 motor housing
106 barrel cover
107 crank housing
108 barrel
108*a* engagement surface

108*b* tool holder holding hole
108*c* groove
108*d* inner space
108*e* front end surface
109 handgrip
111 driving motor
112 motor shaft
113 motion converting mechanism
115 striking mechanism
116 crank chamber
119 hammer bit (tool bit)
121 crank shaft
123 crank arm
125 piston
131 power switch
133 actuating member
135 impact absorption mechanism
136 bit holding device
136*a* engagement pawl
137 tool holder
137*a* flange
138 bit holding hole
138*a* lug
141 cylinder
141*a* air chamber
143 striker
145 impact bolt
163 rubber ring
165 flat washer
181 angular positioning device
183 tool holder guide (first locking member)
183*a* flange
183*b* pawl
183*c* front end
183*d* groove
184 O-ring
185 locking ring (third locking member)
185*a* pawl
185*b* positioning groove
186 spline fit
187 changing ring (second locking member)
187*a* positioning pawl
189 coil spring
191 operating sleeve
193 stopper ring
195 spring receiver
197 stopper ring

What we claim is:

1. An impact tool performing a predetermined hammering operation on a workpiece by a striking movement of a tool bit in an axial direction of the tool bit, comprising:

a tool body having a housing space, a lubricant sealed in the housing space, a driving mechanism that is housed within the housing space and drives the tool bit disposed in a tip end region of the tool body in the axial direction, a tool holder that holds the tool bit in such a manner that the tool bit cannot rotate around an axis of the tool bit with respect to the tool holder, the tool holder being disposed in the tool body in such a manner that it can rotate around the axis of the tool bit, and an angular positioning device that is disposed on a tip end side of the tool body and serves to fix a position of the tool bit around the axis with respect to the tool body, wherein the angular positioning device includes:

a first locking member that is disposed between the tool body and the tool holder in a direction transverse to the axial direction of the tool bit, and connected to the tool body in such a manner that the first locking member cannot rotate around the axis of the tool bit with respect to the tool body and can rotate around the axis of the tool bit with respect to the tool holder, and a second locking member that is disposed opposite to the first locking member in the axial direction of the tool bit, connected to the tool holder in such a manner that it cannot rotate around the axis of the tool bit while being allowed to move in the axial direction of the tool bit with respect to the tool holder, and can be connected to or disconnected from the first locking member according to the movement of the second locking member in the axial direction of the tool bit, in such a manner that it cannot rotate around the axis of the tool bit with respect to the first locking member, wherein one end of the first locking member in the axial direction of the tool bit extends into the housing space of the tool body and is connected to the tool body within the housing space.

2. The impact tool as defined in claim 1, further comprising a third locking member which is disposed between the first locking member and the second locking member in the axial direction of the tool bit, wherein the third locking member is normally connected to the first locking member and can be connected to or disconnected from the second locking member according to the movement of the second locking member in the axial direction of the tool bit, and one surface of the third locking member in a direction transverse to the axial direction of the tool bit contacts the tool body and the other surface contacts a surface of the tool holder which extends in a direction transverse to the axial direction, so that the third locking member serves as a stopper for preventing the tool holder from moving toward the housing space.

3. The impact tool as defined in claim 2, wherein the second locking member and the third locking member have projections and recesses, respectively, in regions opposite to each other in the axial direction of the tool bit and are connected to each other by engagement of the projections and recesses.

4. The impact tool as defined in claim 1, wherein the angular positioning device has an operating member which is operated to move the second locking member in the axial direction of the tool bit, and one end of the operating member is connected to the second locking member and the other end is exposed on the tool body such that the operating member can be manually operated by a user.

5. The impact tool as defined in claim 1, wherein a tool holder guide made of a ferrous material is radially disposed between the tool body and the tool holder in a direction transverse to the axial direction of the tool bit and the holder guide forms the first locking member.

6. The impact tool as defined in claim 1, further comprising:

a tool body, a striker that linearly moves forward in order to strike the tool bit, an intermediate element that transmits a striking force of the striker to the tool bit, a first receiving portion that contacts the striker when the striker further moves forward beyond a predetermined striking position in order to strike the intermediate element, a second receiving portion that contacts the intermediate element when the striker moves forward beyond the striking position and strikes and moves the intermediate element forward, a first elastic element that is held in contact with the first receiving portion and elastically deforms by an impact which is caused by contact between the striker and the first receiving portion and transmitted to the first elastic element, and a second elastic element that is prevented from moving forward by the tool body or by a member on the tool body side which is prevented from moving forward by the tool body, and is held in contact with the first and second receiving portions, and elastically deforms by an impact which is caused by contact of the striker with the first receiving portion and transmitted from the first receiving portion and by an impact which is caused by contact of the intermediate element with the second receiving portion and transmitted from the second receiving portion, wherein:

the first receiving portion and the second receiving portion are disposed side by side in contact with the second elastic element.

7. An impact tool performing a predetermined hammering operation on a workpiece by a striking movement of a tool bit in an axial direction of the tool bit, comprising:

a tool body, a striker that linearly moves forward in order to strike the tool bit, an intermediate element that transmits a striking force of the striker to the tool bit, a first receiving portion that contacts the striker when the striker further moves forward beyond a predetermined striking position in order to strike the intermediate element, a second receiving portion that contacts the intermediate element when the striker moves forward beyond the striking position and strikes and moves the intermediate element forward, a first elastic element that is held in contact with the first receiving portion and elastically deforms by an impact which is caused by contact between the striker and the first receiving portion and transmitted to the first elastic element, and a second elastic element that is prevented from moving forward by the tool body or by a member on the tool body side which is prevented from moving forward by the tool body, and is held in contact with the first and second receiving portions, and elastically deforms by an impact which is caused by contact of the striker with the first receiving portion and transmitted from the first receiving portion and by an impact which is caused by contact of the intermediate element with the second receiving portion and transmitted from the second receiving portion, wherein:

the first receiving portion and the second receiving portion are disposed side by side in contact with the second elastic element.

8. The impact tool as defined in claim 7, wherein one of the first and second receiving portions is held in contact with a radially outward portion of the second elastic element and the other receiving portion is held in contact with a radially inward portion of the second elastic element.

9. The impact tool as defined in claim 8, wherein the first receiving portion comprises a stepped member having a protrusion extending forward from its radially outer edge and is held in contact with the radially outward portion of the second elastic element via the protrusion.

10. The impact tool as defined in claim 9, wherein the stepped member having the protrusion is disposed on the front and rear sides of the first elastic element, and the front and rear stepped members have the same shape and are disposed in symmetry on the both sides of the first elastic element.

11. The impact tool as defined in claim 7, further comprising a cylinder that houses the striker and has a rear end surface and a front end surface in the axial direction of the tool bit which are held in contact with the tool body and the first receiving portion, respectively, wherein the first and second elastic elements are installed under a predetermined pre-load, so that the cylinder is held in the axial direction of the tool bit.

* * * * *